US007106997B2

(12) United States Patent
Stulc et al.

(10) Patent No.: US 7,106,997 B2
(45) Date of Patent: Sep. 12, 2006

(54) INTERMEDIATE TRANSFER MEMBER FOR CARRYING INTERMEDIATE ELECTROPHOTOGRAPHIC IMAGE

(75) Inventors: Leonard Stulc, Shafer, MN (US); Truman Frank Kellie, Lakeland, MN (US)

(73) Assignee: Samsung Electronics Co., Ltd., Suwon (KR)

( * ) Notice: Subject to any disclaimer, the term of this patent is extended or adjusted under 35 U.S.C. 154(b) by 168 days.

(21) Appl. No.: 10/686,930

(22) Filed: Oct. 16, 2003

(65) Prior Publication Data

US 2004/0142271 A1 Jul. 22, 2004

Related U.S. Application Data

(60) Provisional application No. 60/429,713, filed on Nov. 29, 2002.

(51) Int. Cl.
*G03G 15/01* (2006.01)

(52) U.S. Cl. ..... 399/302; 399/308

(58) Field of Classification Search ..... 399/299, 399/302, 303, 306, 308, 309; 430/126
See application file for complete search history.

(56) References Cited

U.S. PATENT DOCUMENTS

| | | | | |
|---|---|---|---|---|
| 3,893,761 A | | 7/1975 | Buchan et al. | |
| 4,430,412 A | | 2/1984 | Miwa et al. | 430/126 |
| 4,684,238 A | | 8/1987 | Till et al. | |
| 4,708,460 A | | 11/1987 | Langdon | |
| 4,796,048 A | | 1/1989 | Bean | |
| 5,099,286 A | | 3/1992 | Nishise et al. | |
| 5,119,140 A | | 6/1992 | Berkes et al. | |
| 5,208,638 A | | 5/1993 | Bujese et al. | |
| 5,233,396 A | | 8/1993 | Simms et al. | |
| 5,298,956 A | | 3/1994 | Mammino et al. | |
| 5,409,557 A | | 4/1995 | Mammino et al. | |
| 5,985,419 A | * | 11/1999 | Schlueter et al. | 428/195.1 |
| 6,066,400 A | * | 5/2000 | Law et al. | 428/412 |
| 6,112,038 A | * | 8/2000 | Takahata | 399/66 |
| 6,336,026 B1 | * | 1/2002 | Heeks et al. | 399/302 |
| 6,647,237 B1 | * | 11/2003 | Schlueter et al. | 399/307 |

FOREIGN PATENT DOCUMENTS

| | | | |
|---|---|---|---|
| JP | 06-118811 | * | 4/1994 |
| JP | 09-160395 | * | 6/1997 |
| JP | 11-282286 | * | 10/1999 |
| JP | 2001-125396 | | 5/2001 |
| JP | 2002-62746 | * | 2/2005 |

* cited by examiner

*Primary Examiner*—Robert Beatty
(74) *Attorney, Agent, or Firm*—Mark A. Litman & Associates, P.A.

(57) ABSTRACT

An electrophotographic imaging apparatus having a first toner accepting layer and an intermediate transfer member. The first toner accepting layer is positioned in electrical contact with a) a charge provider, b) an irradiation source that activates photoconductivity in the first toner accepting layer, and b) at least one toner applicator, so that a first toner image can be formed on the first toner accepting layer. The first toner layer is movable, after interaction with a), b) and c), into contact with the intermediate transfer layer from which the first toner image can be transferred to an image bearing member. The intermediate transfer member comprises a non-conductive flexible film layer, a layer of an electrically conductive material affixed to a first surface of the non-conductive flexible film layer and segmented into electrically isolated regions or zones, and the electrically conductive material layer has an electrically resistive polymeric coating thereon.

24 Claims, 4 Drawing Sheets

INTERMEDIATE TRANSFER MEMBER FOR CARRYING INTERMEDIATE ELECTROPHOTOGRAPHIC IMAGE

RELATED U.S. APPLICATION DATA

This Application claims priority from U.S. Provisional Patent Application No. 60/429,713 filed on Nov. 29, 2002.

BACKGROUND OF THE INVENTION

1. Field of the Invention

This invention relates to an image transfer member for use in electrophotographic printing in which the image transfer member is used to transport an intermediate image between the photoconductive drum and the final image receiving media.

2. Background of the Invention

In the electrophotographic printing process, a toner image is formed on a photoconductive drum using electrostatic techniques that are well known in the art. For example, an organic photoreceptor in the form of a plate, belt, disk, sheet, or drum having an electrically insulating photoconductive element on an electrically conductive substrate is imaged by first uniformly electrostatically charging the surface of the photoconductive element, and then exposing the charged surface to a pattern of light. The light exposure selectively dissipates the charge in the illuminated areas, thereby forming a pattern of charged and lesser charged areas. A liquid or solid ink is then deposited in either the charged or lesser charged areas to create a toned image on the surface of the photoconductive element. The resulting visible ink image can be fixed to the photoreceptor surface or transferred to a surface of a suitable receiving medium such as sheets of material, including, for example, paper, metal, metal coated substrates, overhead printing film, composites and the like. Prior to transfer to a suitable receiving medium, the visible ink image may be transferred to an intermediate transfer member (ITM) that is in contact with and forms a nip ("T-1") with the photoconductive drum. The image is then transported by the ITM to another contact nip ("T-2") where the image is transferred to the final image receptor.

Imaging processes wherein a developed image is first transferred to an intermediate transfer member and subsequently transferred from the intermediate transfer member to an image receptor also are known.

U.S. Pat. No. 4,796,048 (Bean) discloses an apparatus which transfers a plurality of toner images from a photoconductive member to a copy sheet. A single photoconductive member is used. The apparatus may include an intermediate transfer belt to transfer a toner image to a copy sheet with the use of a biased transfer roller. The intermediate transfer belt has a smooth surface, is non-absorbent and has a low surface energy.

U.S. Pat. No. 4,708,460 (Langdon) discloses an intermediate transport belt that is preferably made from a somewhat electrically conductive silicone material having an electrical conductivity of $10^9$ ohm-cm so that the belt is semi-conductive.

U.S. Pat. No. 4,430,412 (Miwa et al.) discloses an intermediate transfer member, which may be a belt-type member that is pressed onto an outer periphery of a toner image retainer with a pressure roller. The intermediate transfer member is formed with a laminate of a transfer layer comprising a heat resistant elastic body such as silicone elastomer or rubber or fluoroelastomer fluorine polymer based rubber, and a heat resistant base material such as stainless steel.

U.S. Pat. No. 3,893,761 (Buchan et al.) discloses a xerographic heat and pressure transfer and fusing apparatus having an intermediate transfer member which has a smooth surface, a surface free energy below 40 dynes per centimeter and a hardness from 3 to 70 durometer (Shore A) hardness. The transfer member, preferably in the form of a belt, can be formed, for example, from a polyamide film substrate coated with 0.1–10 millimeters of silicone rubber or fluoroelastomer. Silicone rubber is the only material shown in the example as the transfer layer.

U.S. Pat. No. 5,099,286 (Nishishe et al.) discloses an intermediate transfer belt comprising electrically conductive urethane rubber reportedly having a volume resistivity of $10^3$ to $10^4$ ohm-cm and a dielectric layer of polytetrafluoroethylene reportedly having a volume resistivity equal to or greater than $10^{14}$ ohm-cm.

U.S. Pat. No. 5,208,638 (Bujese et al.) relates to an intermediate transfer member comprising a fluoropolymer with a conductive material dispersed therein as a surface layer upon a metal layer, which in turn is upon a dielectric layer. The conductive material is dispersed within the fluoropolymer and is not in a separate layer beneath it.

U.S. Pat. No. 5,233,396 (Simms et al.) discloses an apparatus having a single imaging member and an intermediate transfer member which is semiconductive and comprises a thermally and electrically conductive substrate coated with a semiconductive, low surface energy elastomeric outer layer that is preferably Viton® B-50 (a fluorocarbon elastomer comprising a copolymer of vinylidene fluoride and hexafluoropropylene).

U.S. Pat. Nos. 4,684,238 (Till et al.) and 4,690,539 (Radulski et al.) disclose intermediate transfer belts composed of a polyester such as polyethylene terephthalate or other suitable propylene materials.

U.S. Pat. No. 5,119,140 (Berkes et al.) discloses a single layer intermediate transfer belt preferably fabricated from clear, carbon loaded or pigmented Tedlar® (a polyvinylfluoride available from E.I. du Pont de Nemours & Co.). Tedlar® suffers from poor conformability.

U.S. Pat. No. 5,298,956 (Mammino et al.) discloses a seamless intermediate transfer member comprising a reinforcing belt member that is coated or impregnated with a filler material of film forming polymer that can include fluorocarbon polymers.

There are several advantages to using an ITM in electrophotography, especially where multiple colors are used. It is desirable to maximize the print output speed and the fastest of these options is known as the "one pass process" which requires four photoconductive drums in series, one drum for each of the four toner process colors. These four photoconductive drums are in contact with the ITM, which is either a belt or drum to form four T-1 nips. In the case of a belt, biased rollers typically contact the backside of the ITB, creating stability, forming the nips and providing the electrostatic impetus for toner particle transfer. The ITM also forms a T-2 nip with another roller, which also supports a bias, to facilitate toner transfer from the ITM to a final image receptor. The toner images are first overlain in register onto the ITM and then transferred from the ITM to the final image receptor in a single pass by passing the receptor through the T-2 nip. An image transfer belt (ITB) is preferred because of increased flexibility in printer design and space savings over a large image transfer drum. The use of the "one pass process" also increases the life of an electrophotographic device since two to four passes are no longer required to obtain each image. The use of an ITB results in a compact printer with small exterior dimensions and easy placement in cramped office space.

To be effective, an ITB has several minimal requirements. One requirement of an ITB is that a layer be present that has the proper electrical properties to support a bias voltage across each T-1 nip and the T-2 nip. The toner image that is formed on the photoconductive drum consists of very small discreet charged colored particles. This bias voltage is used to induce electrostatic transfer of the toner particles of each image from each photoconductive drum to the ITB at each T-1 nip. A bias voltage is also used to transfer the toner image from the ITB to the final image receptor at the T-2 nip.

A second requirement of an image transfer belt is dimensional stability. This is necessary for accurate registration at the T-1 nips of each color plane of multicolor prints and also for accurate positioning of the image onto the final image receptor.

A third requirement in an image transfer belt is thickness uniformity over the entire area of the ITB. This is necessary to provide uniform and constant pressure in each toner transfer nip to facilitate complete and consistent transfer of toner images.

A fourth requirement of an ITB is durability and long life in a printer.

A bias voltage across each transfer nip is used to induce and assist in the transfer of all the discrete charged toner particles that make up each of the images that were initially formed on each of the photoconductive drums. The bias voltage creates an electric field that must have the proper electrical orientation to move toner particles from one surface to the next at each transfer nip and on through the printer to the final image receptor. If a toner with a positive charge is used, the electric field must be oriented so that a negative charge is produced on the receiving surface. If a toner with a negative charge is used, the electric field must be oriented so that a positive charge is produced on the receiving surface. The orientation of the electric field is controlled by the orientation of the electrical power supply when connected to the bias voltage circuit. In past printers, this bias voltage circuit consists of a power supply, the photoconductive drums, electrically conductive ITB back up rollers and the roller supporting the final image receptor. The ITB back up rollers are preferably electrically isolated from the rest of the printer and the photoconductive drums and the roller supporting the final image receptor are preferably connected to ground. That portion of the ITB located in each transfer nip during ITB rotation is also part of this circuit. As a consequence, the electrical properties of the ITB must be controlled in a way that allows a bias voltage and strong electric field to be maintained at each toner transfer nip for good toner transfer efficiency. If the ITB is too electrically conductive, current will flow through the transfer nip and a bias voltage will not be possible. If the ITB is too electrically resistive, the electric field strength will decrease with increasing ITB thickness. In the prior art, belts that were made thicker to increase ITB durability and longevity suffered adverse effects on electric field strength. Conductive materials have therefore been added to past ITB's to adjust the electrical properties so that the electric field partially emanates from within the ITB. As a consequence, printer configuration requires intimate contact between the ITB and the ITB back up rollers. Contamination of the ITB back up rollers can result from paper lint and/or stray toner and can cause poor roller-to-ITB contact, which reduces the strength of the electric field. This can result in inconsistent toner transfer across the ITB surface.

Image transfer belts currently used in electrophotographic printers can be classified into two categories. There are single layer ITB's and multilayer ITB's. In both cases, complex and difficult manufacturing processes must be employed to produce a functional ITB that meets the requirements specified above.

The difficulties in manufacturing of image transfer belts have been discussed in the prior art. For example, see U.S. Pat. No. 6,397,034 (Tarnawskj, et al.). Here, image transfer belts are made one at a time using monomeric and oligomeric species. Complicated carbon black dispersions and spin casting techniques are used to put a layer of uncured prepolymeric material onto the inside of a metal cylinder. A high temperature curing process is used to bring durability to the final ITB. Belt-like structures are produced upon removal from the casting cylinder.

U.S. Pat. No. 6,228,448 (Ndebi et al.) describes endless belts for use in digital imaging processes that are made one at a time by winding cord or fabric impregnated with various uncured elastomers around a mandrel followed by wrapping with a plastic jacket and heat curing. The cord or fabric is required to provide suitable belt dimensional stability and durability. A cylindrical belt is produced upon removal from the mandrel. This process requires significant time and highly specialized equipment.

U.S. Pat. No. 5,409,557 (Mammino et al.) describes an endless intermediate transfer member that is made using reinforcing monofilament or a reinforcing sleeve made from woven fiber. The monofilament is wound onto a stainless steel mandrel or the sleeve is placed over a stainless steel mandrel. The reinforcing member is then spray coated with a solution of film forming polymer using repeated spray passes to build up a layer of sufficient durability and then the coating is slowly dried at ambient temperatures overnight and then oven dried at 100° C. The slow drying at ambient temperature is apparently to prevent blistering during solvent evaporation from the thick spray coated layer. An endless belt is produced upon removal from the mandrel. This is a slow manufacturing process producing only a single ITB at a time.

U.S. Pat. No. 5,899,610 (Enomoto et al.) describes a process for making an ITB in which an uncured rubber base material is formed on the inside of a centrifugal forming device followed by the application of a surface layer. The belt is then removed from the centrifugal forming device. This process again requires specialized equipment and produces image transfer belts one at a time.

Image transfer belts made by all of these processes require the use of electrically conductive rollers contacting the inner surface of the belt to form the electrical circuit necessary to impart the bias voltage required for electrostatic toner transfer at the T-1 and T-2 nips. This increases the complexity of the electrical circuitry in a printer and brings about uncertainty of electrical continuity between the conductive backup roller and the ITB especially when unwanted stray paper lint and toner contaminate this backup roller/ITB contact point.

In typical image transfer belts, the layer that provides dimensional ITB stability usually consists of a polymeric film or a woven fabric or wound thread that is impregnated with an elastomeric compound. In most cases, monomeric or oligomeric materials are applied as viscous liquids to either the outside of mandrels or the inside of cylinders. These mandrels and cylinders must be precisely machined to make an ITB of the proper size. Techniques used to apply the monomers and/or oligomers must also have high precision to obtain required thickness uniformity over the entire area of the ITB. The applied monomers and oligomers are then heat cured and polymerized to form either a polymeric film or polymeric elastomer. A cylindrical belt is obtained upon removal of the cured polymer matrix from the mandrel or cylinder. Specialized equipment with high precision is necessary to produce an ITB in this way. Also the cured polymers and elastomers by themselves are too electrically resistive at an ITB thickness that provides acceptable durability resulting in a weak electric field and poor toner transfer efficiency. Because of this, materials such as carbon particles and/or metal powders must be used to adjust the electrical properties of the ITB. These particulates are distributed throughout the cured polymeric ITB supporting structure. This requires dispersing these particulates into the viscous monomeric and/or oligomeric materials prior to the belt making operation. A paste-like consistency can result, making application to the mandrel or cylinder difficult unless the viscosity of the paste-like dispersion is reduced by heating. Solvents which could be added to reduce the viscosity of the dispersion cannot be used because the application thickness required for ITB durability is large enough to cause solvent trapping during the curing process and subsequent blistering which reduces ITB yield. These manufacturing processes are also labor intensive with a low ITB manufacturing output rate. All of these factors result in a high ITB cost.

Another ITB has been created that has eliminated all of the complexities of past ITB manufacture while still producing an ITB with all the required ITB functional properties. It provides image transfer belts that use relatively thin coatings on durable films to obtain easy manufacture, and still meets ITB functional requirements at a cost greatly reduced from transfer belts made using previously known processes. This improved ITB has the characteristic, however, that once the biasing brush is applied to the conductive layer, the entire belt is biased to that voltage. While many of the prior art rubber belts are resistive enough to be able to apply independent voltages at each transfer station, toner transfer efficiency is reduced due to the high resistivity and poor roll-to-belt contact. This ITB and system is described in U.S. patent application Ser. No. 10/644,655, filed 20 Aug. 2003, which is incorporated herein in its entirety.

SUMMARY OF THE INVENTION

This invention provides an image transfer belt (ITB), apparatus using the belt, and a method of using the belt in an imaging process that displays the benefits of the thin, flexible, coated belts described above, but additionally is segmented into electrically isolated regions that allow different voltages to be placed at different locations along the same ITB for different steps and/or different qualitative results in the electrophotographic process. This improvement allows for total system optimization of voltages and increases transfer efficiency.

In one aspect of the invention, an intermediate transfer member is described. In the most basic embodiment, the intermediate transfer member has three layers: a non-conductive layer such as film (e.g., electrically insulative film, by way of non-limiting example, especially polymeric insulative film), a conductive layer on top of the non-conductive layer, and a layer that is more electrically resistive than the non-conductive layer (e.g., a polymeric layer) on top of the conductive layer. The non-conductive film layer can be any flexible substrate that will insulate the charged second layer from metal (or other) support rollers; such material may preferably include polyester (e.g., polyethylene terephthalate (PET) or polyethylene naphthalate (PEN)) in one embodiment of the invention. Typically, a film substrate, such as the PET film substrate, might be between 1 and 10 mils (0.025 and 0.25 mm) thick, although any thickness that is flexible will work.

One embodiment of the intermediate transfer member describes a metal, metal filled layer, carbon-filled layer, or semimetal or semimetal filled layer (such as aluminum) as the electrically conductive layer. The conductive layer material may or may not be vapor-coated onto the non-conductive layer for thinness and flexibility. The conductive layer material will preferably have a volume resistivity of less than or equal to $10^4$ ohms/square.

The conductive layer in this aspect of the invention is electrically separated into segments whose widths are the width of the belt and are preferably, but not necessarily, of equal length with other segments. The number of segments a belt contains will vary with the application. The segments are provided with non-conductive or reduced conductivity separation elements between segments (much in the manner that thermal expansion strips are provided on concrete highways). The incorporation of separation elements into the ITB as previously defined should not significantly reduce belt flexibility and durability.

One embodiment of the resistive polymeric coating describes polyurethane coatings. Typically the best working range for polyurethane coatings is with a electrical resistance per unit area equal to or between $10^6$ and $10^{13}$ ohms/cm$^2$.

Another embodiment of the resistive coating describes the use of fluorosilicone prepolymers in forming the electrically resistive coating. Typically the best working range for the fluorosilicone prepolymers is an electrical resistance per unit area equal to or between $10^6$ and $10^{13}$ ohms/cm$^2$.

Another aspect of the invention is a method of producing an image in an inventive apparatus using the ITB of the invention. The general steps of the method include a first step of exposing and developing at least one image on at least one image receiving member. A second step includes: transferring the image or images to an intermediate transfer member such as the one described above, having a substantially non-conductive layer, a conductive layer, and a resistive layer; the intermediate transfer member being conformable to the image receiving member and being charged by applying a voltage (usually directly) to the segment of the conductive layer of the intermediate transfer member that is at the first image transfer station, usually by a brush or probe in contact with the conductive layer at that segment. A third step describes applying a voltage different from the one applied in step two (to achieve optimum transfer efficiency) to the electrically separated (e.g., conductively separated) segment of the intermediate transfer member that is at the second transfer station and transferring the image or images to a receiving substrate, to achieve an effective toner transfer, preferably as close to 100% toner transfer as possible.

DETAILED DESCRIPTION OF THE INVENTION

Figure 1:
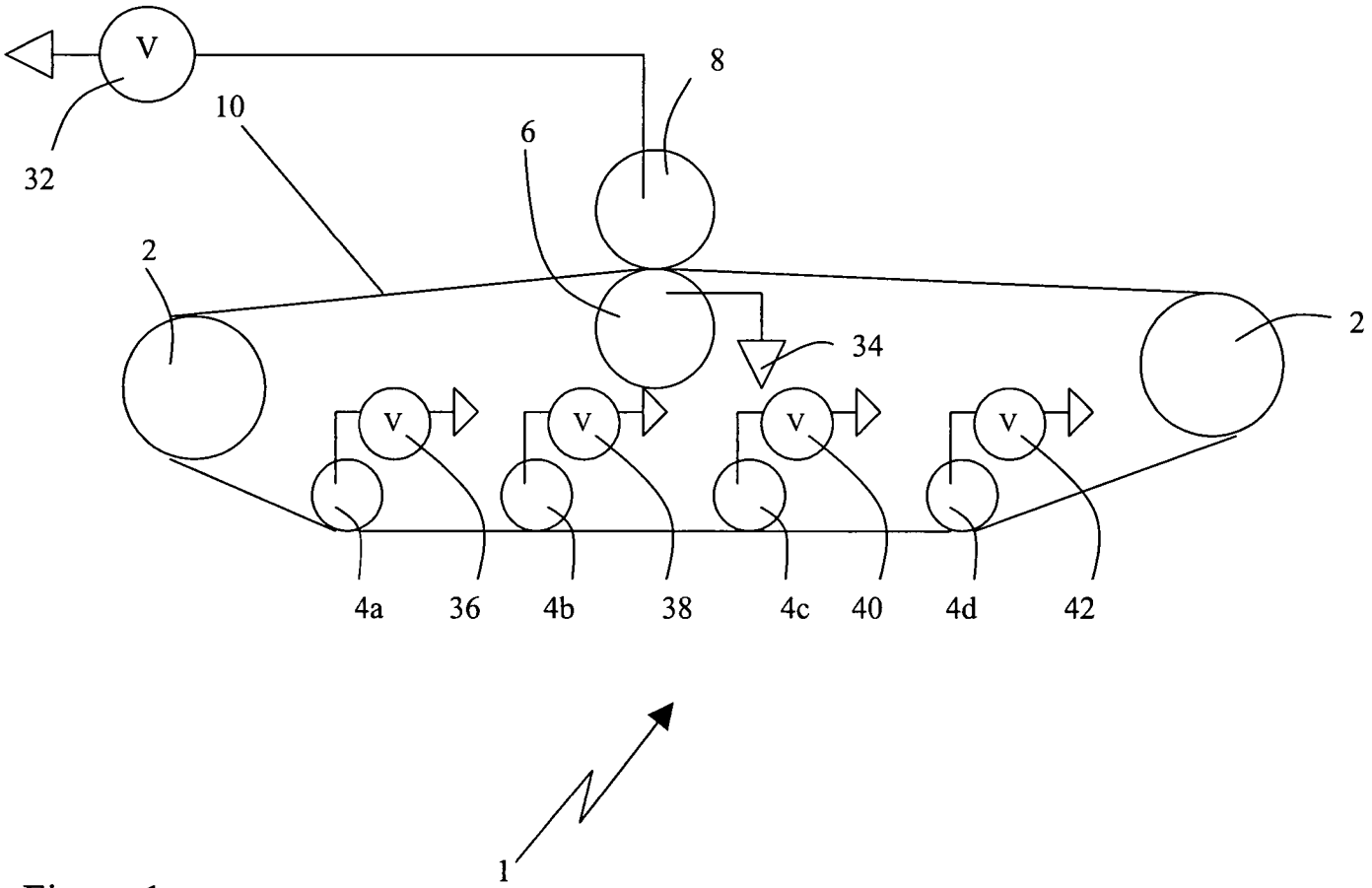
Figure 1 Prior Art
FIG. 1 shows an apparatus typically associated with the prior art.

In the present invention, an endless image transfer belt is made using durable nonconductive film such as polymeric film, such as polyester film, and most preferably polyethylene terephthalate (PET) film that has been coated, and preferably vapor coated on one side with a thin layer of an electrically conductive material such as metal or semimetal material, such as aluminum. (This material will subsequently be referred to as an Al/PET substrate, although other nonconductive materials and other metallic and non-metallic conductive materials are known and contemplated within the practice of the invention). An Al/PET substrate is dimensionally stable, has excellent thickness uniformity, excellent durability and is readily available in long thin webs of various widths and thicknesses and can be obtained in coils up to 5,000 feet long. Al/PET webs can be coated in a continuous operation using common high speed, coil to coil precision web coating techniques such as knife coating, reverse roll coating, extrusion coating, curtain coating and the like.

The invention also relates to an electrostatic imaging system having an intermediate transfer member to which a toner image is formed as a first transferred image from a first image-bearing surface. The system may, for example, comprise an electrostatic image-forming system, the first image-bearing surface, the intermediate transfer member, and a second image receiving surface that receives an image transferred from the intermediate transfer member. The intermediate transfer member may, for example, comprise;

a non-conductive flexible film layer, a layer of an electrically conductive material affixed to a first surface of the non-conductive flexible film layer, and the electrically conductive material layer having at least one electrically resistive polymeric coating thereon.

The electrically conductive layer preferably has segments (distinctly identifiable units, and preferably distinctly chargeable units that are capable of sustaining different charges than other units for a period of at least 30 seconds). Between the segments preferably there is reduced electrical conductivity or essentially no electrical conductivity that would enable equilibration of charges on the segments in less then five minutes. The system may have an electrically insulating gap between the segments that is an actual open space between segments that are connected by non-conductive connectors (bridging elements, straps, fabric, non-conductive polymer, non-conductive hinges, and the like). The conductive layer may have been scored or segmented laterally into electrically isolated regions. It is one method of practice for the resistive polymeric coating to coat less than 100% of the conductive material, leaving a continuous conductive strip along an edge of the intermediate transfer member. This strip may then be used for electrical access during operation. The non-conductive film layer preferably comprises a polyester, such as polyethylene terephthalate.

In the present invention, the Al/PET substrate is precision coated with an electrically resistive film forming polymeric material. Suitable polymeric materials include but are not limited to polydialkylsiloxanes, polyalkylarylsiloxanes, polyvinyl acetals, polyvinylbutyrals, polycarbonates, polyurethanes, polyesters, polyamides, vinylchloride/vinyl acetate copolymers, polyacrylates. polymethacrylates, cellulose acetate butyrate, and various fluoropolymers including ETFE (ethylene-tetrafluoroethylene), FEP (fluoroethylene-propylene), PFA (tetrafluoroethylene-perfluorovinylether), and THV (tetrafluoroethylene-hexafluoropropolyene-vinylidenefluoride). Various polymeric elastomers and rubbers can also be used alone or in combination with the other polymeric materials and include butadiene-acrylonitrile rubber, chloroprene rubber, epichlorohydrin rubber, fluorosilicone elastomers, fluoroelastomers, nitrile butadiene rubber, polyacrylate rubber, polyether rubber, polyurethane elastomers, silicone rubber, polysulfide rubber and the like. Coatings containing dispersed particulates can also be used.

The polymeric coating is applied onto the side of the Al/PET having the thin conductive layer, such as the layer of vapor coated aluminum or other conductive material and forms the toner transfer surface in a printer. The Al/PET with the polymeric coating is then cut into sheets of the proper size and the ends of these sheets are lapped and joined (e.g., ultrasonically welded, adhesively secured, mechanically secured) to form a durable endless belt. The sheet size is controlled so that the (e.g.,) welded endless belt will fit into an electrophotographic printer. Insulative strips or segment binders may be provided with electrically insulating properties to enhance the resistive blocking or electrically reduced conductivity between segments. Different conductivities for adjacent segments may also be provided in the construction by joining conductively distinct segments.

The electrical properties of the polymeric coating are controlled by design and composition so that a bias voltage can be supported across this coating. This is done by adjusting the electrical resistance per unit area by controlling the dry coating thickness and by proper selection and formulation of the polymeric coating. A comparative measure of electrical resistance per unit area can be obtained by using an instrument consisting of an adjustable electrical power supply with voltage control, a precision amp meter and a surface contact electrode. An instrument suitable for determining colume resistivity can be used. Such an instrument can be set up by combining a Resistance/Current Meter Model 278 manufactured by Electo Tech Systems, Inc. of Glenside, Pa. which consists of an adjustable electrical power supply and a precision amp meter with a Model 803B surface contact electrode both manufactured by Electro Tech Systems Inc. of Glenside, Pa. The resistance per unit area of a coating on Al/PET can be measured by placing the surface contact electrode on the polymeric coating and connecting the underlying aluminum layer to an amp meter. A comparative value for electrical resistance per unit area is obtained by applying a 500 volts through the coating similar to the bias voltage used in a printer and measuring the current with the precision amp meter. Resistance per unit area in ohms/cm$^2$ ise determined by dividing the applied voltage (in this case, 500 volts) by the measured current in amps. This result is then divided by 7.07 cm$^2$, which is the area of the Model 803B surface contact electrode, to obtain resistance per unit area in ohms/cm$^2$. If the surface contact electrode has an area of 1.0 cm$^2$ then resistance per unit area in ohms/cm$^2$ is obtained directly by dividing the applied voltage by the measured current in amps.

The width of the polymeric coating is also controlled so that a 30 mm wide strip of vapor coated aluminum along one edge of the web is left uncoated by the polymer so that electrical contact may be made to the aluminum strip from the surface. During operation in a printer, a conductive brush or roller contacts this aluminum strip as part of the electrical circuit that is necessary to induce electrostatic toner transfer. This allows the exemplary underlying electrically conductive, vapor coated aluminum layer to be electrically biased across the entire surface plane of each electrically isolated ITB segment. This induces electrostatic toner transfer either from the photoconductive drum to each segment of the ITB or from each segment of the ITB to the final image receptor. In a printer the nonconductive PET film, which forms the durable and flexible support for the ITB, rotates on supporting rollers. Electrical contact between these back up rollers and the ITB is not necessary as required with past ITB's, although it may be allowed.

The segments in the belt may be created in a number of different ways. One simple way is where segments are created when the conductive layer of the ITB is broken up into independent regions. This can be done by scribing or removing the conductive layer from the PET or non-conductive layer width-wise along the ITB at required intervals. The conductive layer can be scribed either prior to or after the more resistive coating is applied. The width of the section removed can vary from 1 mil to several mils wide, keeping in mind the voltage differentials to be placed on each segment and the conductivity of the material (coating) or air in the scribed region (dry air conducts 300V/mil). A preferred range is between 3 and 5 mils. It is important to maintain the electrical isolative integrity of each segment of the ITB. Alternatively, the conductive layer may be coated in discontinuous segments, or where segments are welded or bonded together, non-conductive or less conductive spacing layers can be provided between segments.

An ITB made as specified in this invention allows the use of simplified printer circuitry by use of only a continuity brush or roller to contact the electrically conductive strip on the belt edge so that the ITB can be electrically energized without the need for electrically conductive ITB back up rollers and the resulting need for uniform electrical contact between the back up roller and the ITB.

An electrostatic image transfer apparatus according to the invention may comprise, by way of a non-limiting description: a source of electrostatic toner; an electrophotoconductive surface on which a first toner image is formed; an intermediate transfer member to which the first toner image is transferred from the electrophotoconductive surface to form a first transferred toner image; and a second image receptor to which the first transferred toner image can be subsequently transferred. The intermediate transfer member may comprise:

a non-conductive flexible film layer, a layer of an electrically conductive material affixed to a first surface of the non-conductive flexible film layer, and the electrically conductive material layer having at least one electrically resistive polymeric coating thereon, wherein the electrically conductive layer has segments between which there is reduced conductivity. The segments may be spaced apart by reduced conductivity regions that can be positioned during practice of the apparatus so that no imaging or no important imaging occurs on the spacing areas. This can be done by manual adjustment or automatic adjustment, as with a sensor that identifies respective areas according to their conductivity and adjusts movement of imaging and image-accepting portions of the belt to avoid an attempt to place toner or image-intended toner onto the lower-conductive areas.

EXAMPLE

A fluorosilicone prepolymer from General Electric Co. with the designation FRV1106 was coated onto Al/Pet and then made into an ITB. This was accomplished by first preparing a 40% solution of FRV1106 in MEK. 398.4 grams of FRV1106 and 1.6 grams of tetrabutyl titanate (TBT) catalyst from Du Pont were added to 600 grams of MEK in a glass jar. The jar was tightly capped and the FRV1106 brought into solution by putting the jar on an oscillating shaker for 4 hours.

A roll to roll coater with an extrusion type coating bar was used to apply the FRV1106 solution to the Al/PET web. The coating bar has a narrow extrusion slot oriented perpendicular to the web and is positioned so that liquids and solutions can be applied to the Al/PET web as a thin liquid coating as the Al/PET web is pulled past the extrusion slot. A positive displacement pump and associated plumbing is used to meter the coating liquid through the extrusion bar slot and onto the moving web. The size of the positive displacement pump is 292 cc/min. Both the wet film coating thickness and the coating width can be controlled with high precision. The web passes through a heated forced air oven to dry and cure the coating and the temperature of the drying oven can be controlled as needed.

A coil of 3 mil Al/PET was mounted onto the unwind stand of the roll to roll coater. The 3 mil Al/PET web was threaded past the coating extrusion bar and on through the heated forced air drying oven and on further to a receiving drum mounted on the wind up stand. The width of the extrusion slot was adjusted and the extrusion slot positioned relative to the Al/PET web so that a 15 mm wide strip of vapor coated aluminum along one edge remained uncoated. The coater oven temperature was brought to 130° C. This solution was then pumped to the extrusion bar slot and onto the moving Al/PET web. In this example, 30 foot sections of the web were extrusion coated in intervals and with each section being stopped for 5 minutes in the oven to allow the fluorosilicone prepolymer to cure to a durable polymeric elastomer before being wound into a coil on the wind up stand. A first fluorosilicone coating on Al/PET was made with a pump speed of 16 rpm. This coating had a dry thickness of 8 microns and was labeled condition 2. A second coating fluorosilicone coating (of the same composition) was made with a pump speed of 32 rpm. This coating had a dry thickness of 12 microns and was labeled condition 3. The resistance per unit area at 500 applied volts for condition 2 was found to be $1.2\times10^9$ ohms/cm$^2$. The resistance per unit area at 500 applied volts for condition 3 was found to be $1.5\times10^9$ ohms/cm$^2$.

The segments for each belt were created after the ITB was cut into sheets that were 330 mm wide and 812 mm long using a precision template. At intervals of approximately 203 mm, both the coating and the conductive layer were scribed, removing approximately longitudinal 3 mils of material at each segment boundary.

The ends of the 812 mm dimension were overlapped by 20 mils on the anvil of an ultrasonic welder made by the Branson Co. and fused together to form an endless belt of the proper size for a laboratory test bed printer.

A general electrostatic system with image-transfer apparatus 1 according as currently practiced in the art is shown in FIG. 1. At least two rollers 2 are provided to provide support for the intermediate transfer belt 10 which may range in resistivity from very conductive to very resistive, depending on the parameters of the machine. For example, if the intermediate transfer belt is very conductive, the support rollers 2 will be insulative while the biased backup rollers 4*a*, 4*b*, 4*c*, 4*d*, and 6 will likely be biased to the same voltage (not shown). If the intermediate transfer belt 10 is very resistive (for example, $10^{10}$ or higher) the biased backup rollers 4*a*, 4*b*, 4*c*, 4*d*, and 6 will frequently be independently biased or grounded (as needed) to achieve the best possible results.

Figure 2:
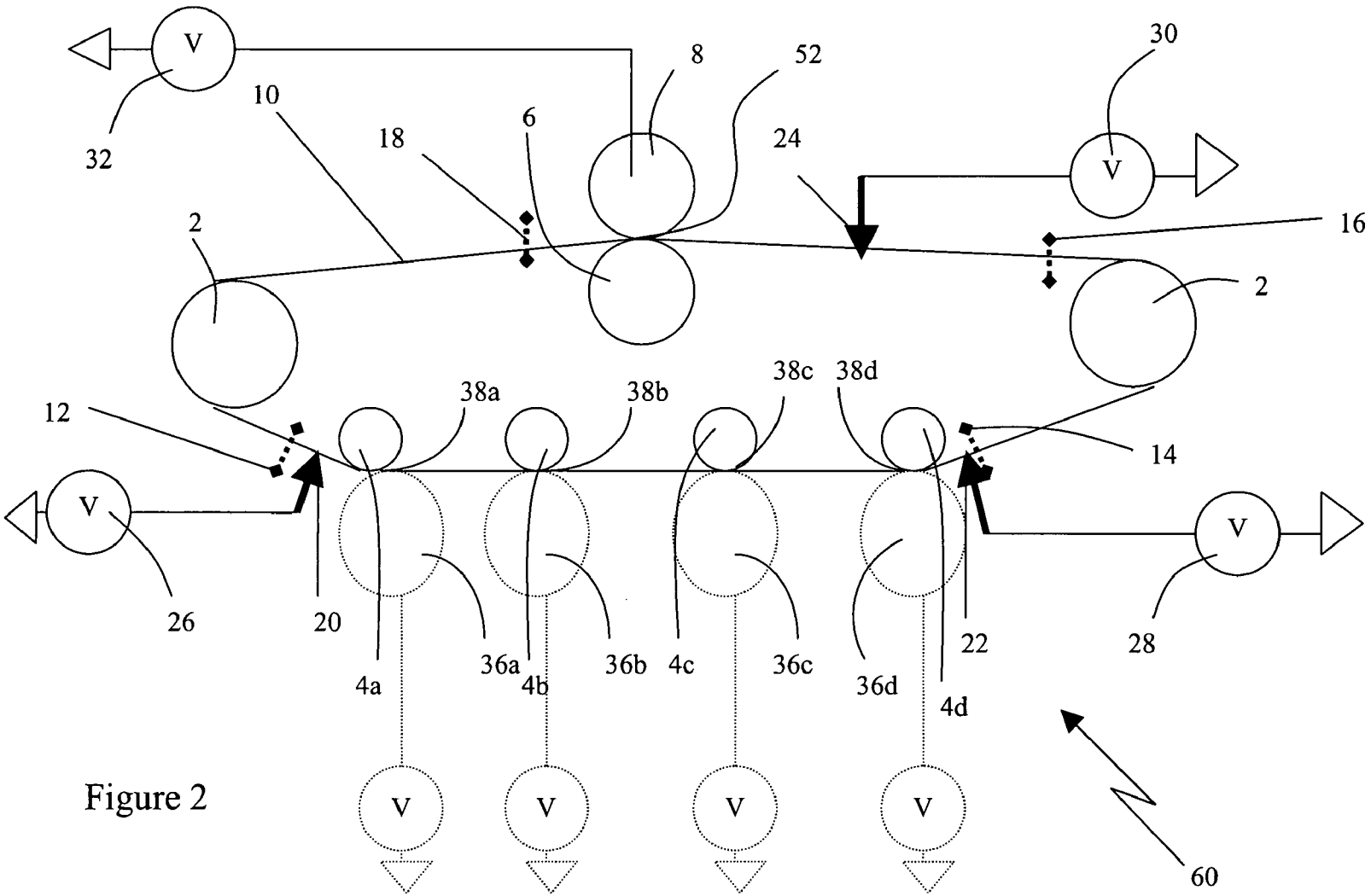
FIG. 2 shows the apparatus of the present invention.
Figure 3:
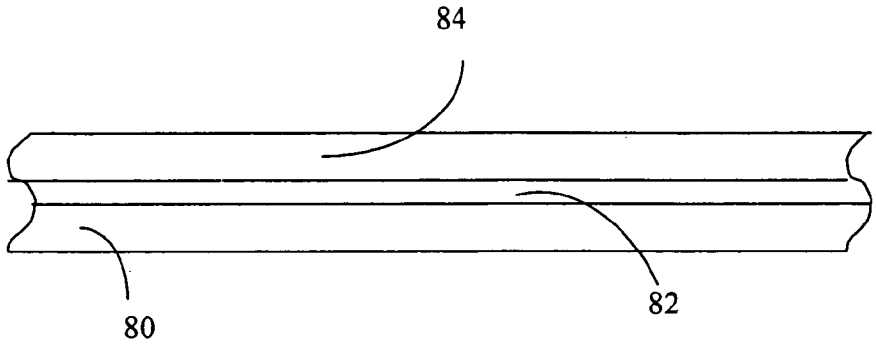
FIG. 3 shows a cutaway view of the article of the present invention, showing the strata incorporated in the intermediate transfer belt.
Figure 4:
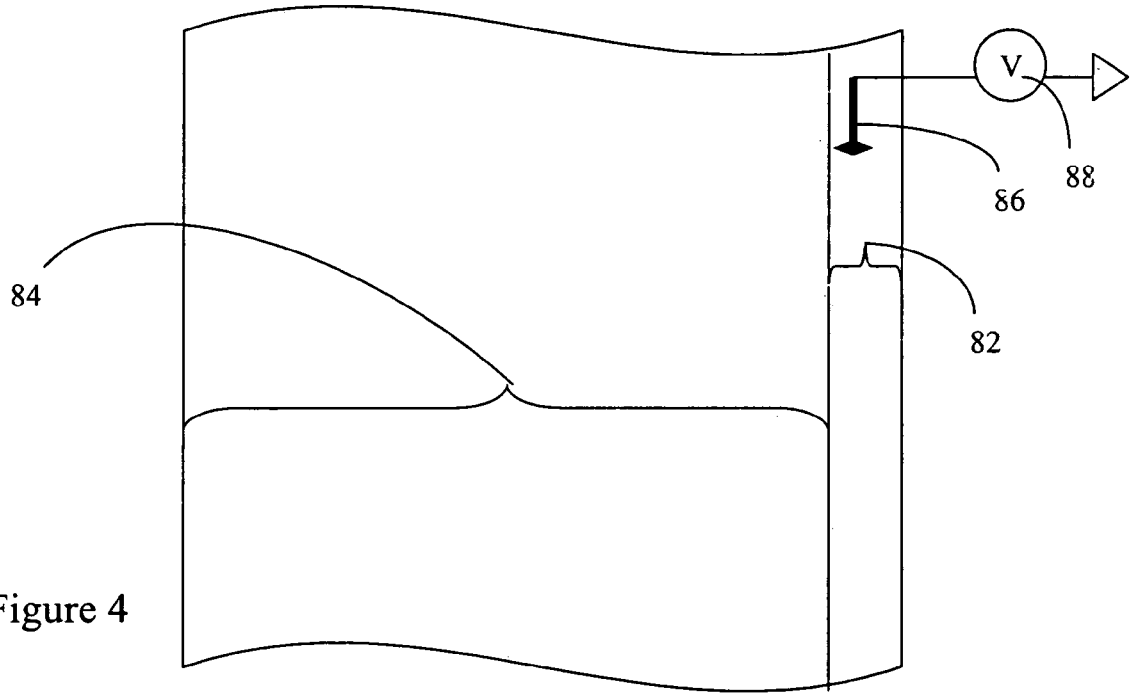
FIG. 4 shows a top view of the article of the present invention.
Figure 5:
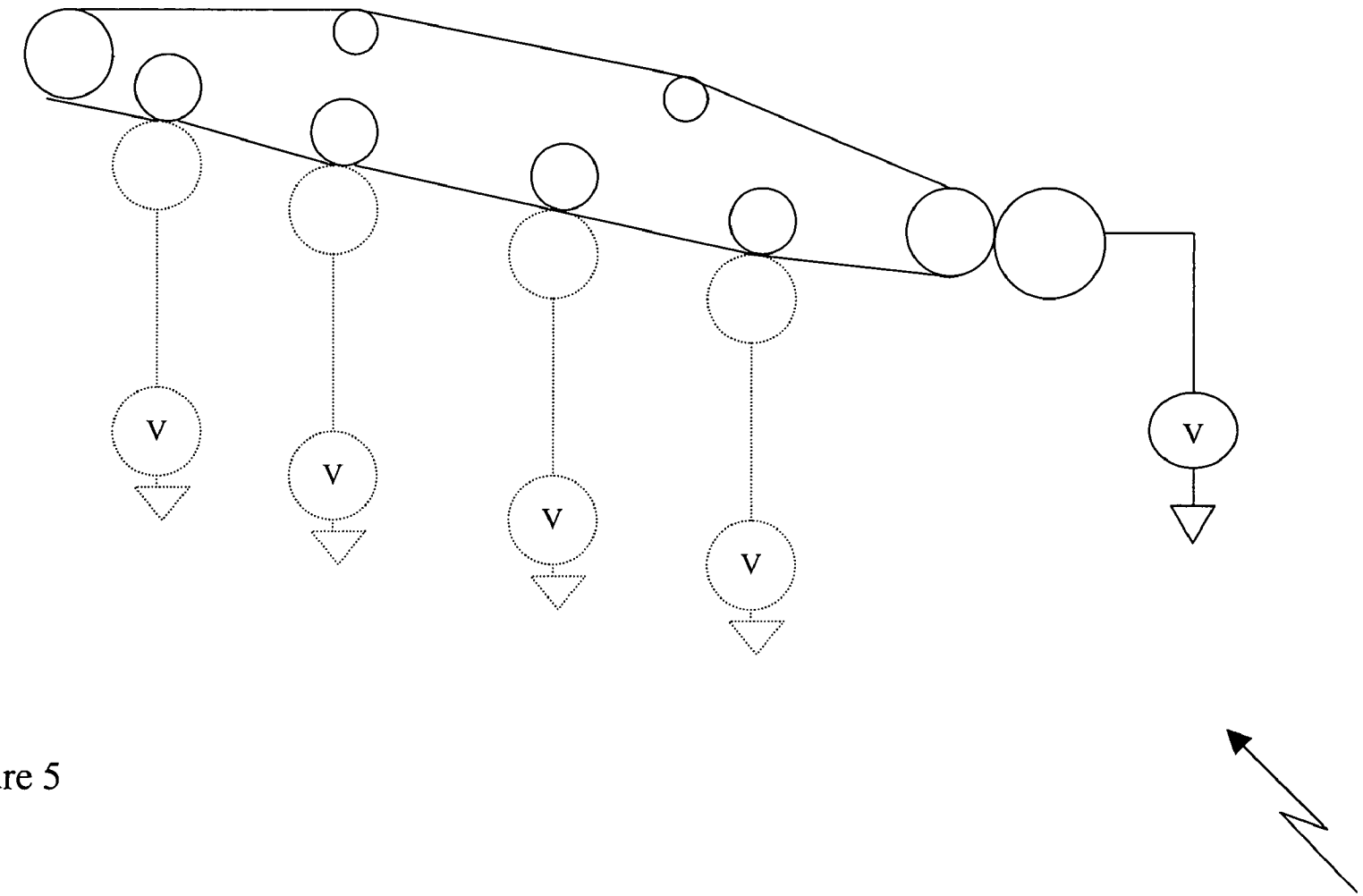
FIG. 5 shows a schematic side view of a complete four-stage toning system according to one practice of the invention.

FIG. 2 shows a transfer apparatus 60 according to the present invention. All internal rollers 2, 4*a*, 4*b*, 4*c*, 4*d*, and 6 are unbiased and are probably insulative backup rollers. The intermediate transfer member 10 for such an apparatus 60 is shown in FIG. 3. and is made by coating at least one resistive layer 84 on top of a conductive substrate 82 that is either coated on or part of an insulative film or substrate 80. The resistive coating(s) 84 should not completely cover the conductive layer 82 as shown in FIG. 4 in order that a biasing 88 brush or probe 86 may be used to bias the conductive layer 82 uniformly.

In FIG. 2, the intermediate transfer member 10 also is scored or segmented at specific intervals in the circumference, as shown by the marks 12, 14, 16, 18. The segments are spaced so that the conductive layer is broken up into independent planes or segments allowing each segment to support a different bias voltage. (See below for methods of creating the segments.) The apparatus 60 includes biasing brushes or probes 20, 22, 24 by which a voltage 26, 28, 30 is applied. In this way the nips 38*a*, 38*b*, 38*c*, 38*d* (also referred to as "T1") created by the backup rollers 4*a*, 4*b*, 4*c*, 4*d* and the photoconductive drums 36*a*, 36*b*, 36*c*, 36*d* maintain a different bias than the nip 52 ("T2") created by the transfer roll 8 and the transfer roll backup 6. This is important because the electrical field required to support a first (T1) transfer is not the same field required for the second (T2) transfer (i.e. at T1, the ITB voltage is used to pull toner particles from the first image bearing member or photoconductor to the ITB; at T2, the ITB preferably is either neutral or pushes the toner particles from the ITB to the final image receptor).

One skilled in the art recognizes that the above enabling description is exemplary and is not intended to be limiting. Alternative materials satisfying the required properties described and alternative construction performing the functions described can be provided within the practice of the invention contemplated. The claims to the concepts and structures of the invention should be interpreted in this light.

We claim:

1. An electrostatic imaging system having an intermediate transfer member to which a toner image is formed as a first transferred image from a first image-bearing surface, the system comprising an electrostatic image-forming system, the first image-bearing surface, the intermediate transfer member, and a second image receiving surface that receives an image transferred from the intermediate transfer member;

the intermediate transfer member comprising;

a non-conductive flexible film layer, a layer of an electrically conductive material affixed to a first surface of the non-conductive flexible film layer, and the electrically conductive material layer having at least one electrically resistive polymeric coating thereon, wherein the electrically conductive layer has exactly one, two, three or four segments between which segments there is reduced conductivity, electrically isolated regions.

2. The system of claim 1 wherein there is an electrically insulating gap between the segments.

3. The system of claim 2 wherein the conductive layer has been scored or segmented laterally into electrically isolated regions.

4. The system of claim 1 wherein the resistive polymeric coating coats less than 100% of the conductive material, leaving a continuous conductive strip along an edge of the intermediate transfer member.

5. The system of claim 1 wherein the non-conductive film layer comprises polyethylene terephthalate.

6. The system of claim 5 wherein the polyethyleneterephthalate is between 0.025 mm and 0.25 mm thick (0.001 to 0.010 inches).

7. The system of claim 1 wherein the electrically conductive material layer comprises aluminum.

8. The system of claim 1 wherein the electrically conductive material layer has been vapor coated on the non-conductive film layer.

9. The system of claim 1 wherein the electrically conductive material layer has a volume resistivity of less than or equal to $10^4$ Ohms/square.

10. The system of claim 1 wherein the resistive polymeric coating has an electrical resistance per unit area of between $10^3$ and $10^{13}$ ohms/cm$^2$.

11. The system of claim 1 wherein the resistive coating comprises a polyurethane layer.

12. The system of claim 11 wherein the polyurethane layer has an electrical resistance per unit area of between $10^3$ and $10^{13}$ ohms/cm.

13. The system of claim 1 wherein the resistive coating layer is a fluorosilicone prepolymer.

14. The system of claim 13 wherein the fluorosilicone prepolymer has an electrical resistance per unit area of between $10^3$ and $10^{13}$ ohms/cm.

15. The system of claim 1 wherein the intermediate transfer member is divided into two electrically independent segments.

16. The system of claim 1 wherein the intermediate transfer member is divided into three electrically independent segments.

17. The system of claim 1 wherein the intermediate transfer member is divided into four electrically independent segments.

18. A method for producing an image in an electrophotographic imaging apparatus, the method comprising:

exposing and developing at least one electrophotographic image on at least one first image receiving member;

transferring the at least one image to an intermediate transfer member in a first transfer step, wherein the intermediate transfer member comprises a non-conductive layer, a conductive layer, and a polymeric electrically resistive layer, wherein the electrically conductive layer has exactly one, two, three or four segments between which segments there is reduced conductivity, electrically isolated regions, wherein the resistive layer of the intermediate transfer member is conformable to the first image receiving member, and biasing the conductive layer at the first transfer step by applying a first voltage directly to the conductive layer with at least one brush or probe directly in contact with the conductive layer; and transferring the at least one image to a second image receiving substrate in a second transfer step, biasing the conductive layer at the second transfer step by applying a second voltage directly to the conductive layer by at least one brush or probe directly in contact with the conductive layer, and transferring in excess of 97% toner transfer from the intermediate transfer member to the second image receiving substrate.

19. The method of claim 18 wherein the conductive layer comprises segments of conductive material where the segments have insulated spaces between adjacent segments.

20. The method of claim 18 wherein the method results in greater than 99% toner transfer from the intermediate transfer member to the second image receiving substrate.

21. The method of claim 18 wherein the method results in greater than 97% toner transfer from the first image receiving member to the intermediate transfer member to the second image receiving substrate.

22. The method of claim 18 wherein the method results in greater than 99% toner transfer from the first image receiving member to the intermediate transfer member to the second image receiving substrate.

23. An electrostatic image transfer apparatus comprising:

a source of electrostatic toner;

an electrophotoconductive surface on which a first toner image is formed;

an intermediate transfer member to which the first toner image is transferred from the electrophotoconductive surface to form a first transferred toner image; and a second image receptor to which the first transferred toner image can be transferred;

the intermediate transfer member comprising:

a non-conductive flexible film layer, a layer of an electrically conductive material affixed to a first surface of the non-conductive flexible film layer, and the electrically conductive material layer having at least one electrically resistive polymeric coating thereon, wherein the electrically conductive layer has exactly one, two, three or four segments between which there is reduced electrical conductivity, providing electrically isolated regions.

24. An intermediate transfer member on which a toner image is formed as a first transferred image bearing member, and to which the toner image is first transferred and from which the first transferred toner image is transferred a second time onto a second image bearing member; the intermediate transfer member comprising:

a non-conductive flexible film layer, a layer of an electrically conductive material affixed to a first surface of the non-conductive flexible film layer, and the electrically conductive material layer having at least one electrically resistive polymeric coating thereon, wherein the electrically conductive layer has exactly one, two, three or four segments between which there is reduced conductivity, providing electrically isolated regions.

* * * * *